United States Patent [19]

Luthra

[11] Patent Number: 4,620,128

[45] Date of Patent: Oct. 28, 1986

[54] TUNGSTEN LADEN EMISSION MIX OF IMPROVED STABILITY

[75] Inventor: Krishan L. Luthra, Schenectady, N.Y.

[73] Assignee: General Electric Company, Schenectady, N.Y.

[21] Appl. No.: 728,352

[22] Filed: Apr. 29, 1985

[51] Int. Cl.[4] ..... H01J 17/04

[52] U.S. Cl. ..... 313/630

[58] Field of Search ..... 313/630, 633

[56] References Cited

U.S. PATENT DOCUMENTS 3,708,710 1/1973 Smyser et al. ..... 313/630 X

*Primary Examiner*—Stewart J. Levy
*Assistant Examiner*—Joseph W. Roskos
*Attorney, Agent, or Firm*—Paul E. Rochford; James C. Davis, Jr.; Paul R. Webb, II

[57] ABSTRACT

High pressure sodium lamps have been subject to progressive reduction in pressure of contained sodium with attendant reduction in lighting quality. It has now been discovered that modification of lamp components permits the pressure of contained sodium to be maintained at higher levels. Emission materials enclosed within the lamp are altered to limit reactive oxygen in the lamp atmosphere. A thermionic electrode is equipped with an improved emission mix composition containing an oxide selected from the group consisting of tungsten, molybdenum and yttrium. The emission mix also contains the metal of the respective oxide in finely divided form.

8 Claims, 3 Drawing Figures

TUNGSTEN LADEN EMISSION MIX OF IMPROVED STABILITY

CROSS REFERENCE TO RELATED APPLICATIONS

The Patent and Trademark Office may want to consider two copending applications in relation to the subject matter of the subject application. The first is Ser. No. 698,512 filed Feb. 4, 1985 and the second is Ser. No. 728,556 filed Apr. 29, 1985, both of which are commonly assigned with this application and both of which are incorporated herein by reference.

BACKGROUND OF THE INVENTION

The present invention relates generally to high pressure sodium and similar lamps having emission mixes disposed on the electrodes thereof. More particularly, it relates to modification of lamp structure and components to overcome a problem of loss of pressure within the lamp envelope, and particularly the loss of sodium in sodium vapor lamps. It further relates to a method and structure to avoid the reduction of the high pressure of sodium vapor which is necessary to the favorable operation of the lamp.

As used herein the term deluxe, as it is used in reference to high pressure sodium of HPS lamps, means a lamp having a pressure of sodium substantially higher than that of standard or conventional HPS lamps. For convenience of reference DHPS is employed as an alternative designation to the phrase deluxe high pressure sodium as used in connection with lamp structures. The term also designates a lamp which emits a light which is substantially white as contrasted with the light emitted from standard HPS lamps. The light emitted from standard HPS lamps is characteristically golden in coloration.

Components for lamps for the generation of light, which may involve the use of sodium and particularly sodium in high pressure, are disclosed in U.S. Pat. Nos. 3,026,177; 3,026,210; 3,485,343; 3,708,710; 3,935,494; 4,079,167; 4,150,317; 4,285,732 and 4,374,339. The text of these patents, which are assigned to a common assignee herewith, are incorporated herein by reference.

As is explained in the above patents, sintered polycrystalline aluminum oxide is used as the jacket materials for discharge tubes of lamps. Such lamps may contain high pressure sodium (HPS) or the higher pressure sodium of deluxe (or DHPS lamps) in the discharge tubes. It is possible to obtain the desired partial pressure of sodium in these tubes by using an amalgam of sodium in mercury.

One of the major factors limiting the life of lamps employing the high pressure sodium discharges is the loss of sodium from the discharge. When the partial pressure of sodium within the discharge tube of the lamp is reduced, the light output of the lamp is affected. When the loss of sodium from the vapor phase in the lamp is large, the lamp may not even light when electric voltage is applied to the lamp in the conventional manner to induce operation.

Further it has been observed that a lamp, which initially has a suitably high pressure of sodium for deluxe HPS use, may gradually lose its pressure over a period of lamp use. Thus, although the lamp operates well initially, the useful life of the lamp may be so limited as to make sale and use of the lamp in commerce uneconomical or impractical. The standard HPS lamps have an unpleasant golden color. To be a color improved HPS lamp, so called deluxe lamp (DHPS lamp), the lamp should operate with high pressure of sodium and this pressure is two or three times the pressure of sodium in a standard or conventional HPS lamp. One advantage of such deluxe lamps is that they emit a light which is whiter than that emitted from the lower pressure standard HPS lamps. Standard HPS lamps have lives of the order of 20,000 hours. It has been observed that within 3,000 to 10,000 hours of operation of deluxe HPS lamps (DHPS lamps), they may lose their color advantage and revert to the standard HPS lamps which emit the unpleasant golden color.

Standard HPS lamps can also be adversely affected by the loss of sodium vapor, for example, by limiting their expected operating lives.

A number of studies have been made and are reported in the literature which have been concerned with the mechanisms by which sodium is lost from high pressure sodium lamps. The following are a number of reports which have been made on this general subject:

(A) A. Inouye, T. Higashi, T. Ishigani, S. Nagamo and H. Shimojima, Journal of Light and Vis. Env. 3 (1979) 1.

(B) P.R. Prud'homme V Reine, "Science of Ceramics", Proceedings of the Twelfth International Conference, June 27–30, 1983, Saint-Vincent, Italy, P. Vincenzini (Ed.), Ceramurgica, Italy, 1984, p. 741.

(C) E.F. Wyner, Journal of IES, 8 (1979) 166.

(D) H. Akutsu, Ph.D. dissertation, "Development of High Pressure Sodium Lamps", Matsushita Electronics Corp., Osaka, Japan, 1982.

(E) F.C. Lin and W.J. Knochel, Journal of IES, 3 (1974) 303.

(F) P. Hing, J. Illum. Eng. Soc. 10 (1981) 194.

In the first article, identified as A above, the suggested mechanism for the reduction in the pressure of sodium vapor is one by which leakage occurs through the seal glass. According to references C and E involved, the suggested mechanism for the loss of the sodium of the high pressure sodium vapor is by electrolysis through the tube wall.

The mechanism suggested in the references of D and F is one according to which a reaction occurs with the tube wall and diffusion occurs through the wall. Many investigators believe that the sodium loss occurs by this latter mechanism.

These latter references also suggest that sodium present in the arc tubes reacts with the alumina of the enclosing tube to form beta alumina having formula $Na_2O.11\ Al_2O_3$ and/or sodium aluminate having the formula $NaAlO_2$.

BRIEF SUMMARY OF THE INVENTION

It is accordingly one object of the present invention to provide a high pressure sodium lamp article which is not as subject to loss of the pressure of sodium vapor as prior art lamps.

Another object is to provide a means by which the high pressure of sodium vapor in an HPS lamp may be retained for an extended period.

Another object is to provide a method of improving the retention of sodium vapor in lamps at high pressure.

Another object is to provide means by which the retention of sodium vapor of deluxe higher pressure sodium lamps may be improved so that they emit a whiter light for a longer time.

Another object is to enhance the operation of high pressure sodium lamps by reducing the tendency of HPS lamps, both deluxe and standard, to loss of pressure of sodium vapor.

Other objects will be in part apparent and in part pointed out in the description which follows.

In one of its broader aspects objects of the invention can be achieved by providing a high pressure sodium vapor lamp having an emission material of a composition selected from the areas designated A and B of the accompanying graph of FIG. 3 and having a finely divided tungsten metal admixed therewith.

BRIEF DESCRIPTION OF THE DRAWINGS

The description of the invention which follows will be aided by reference to the accompanying drawings in which.

DESCRIPTION OF THE PREFERRED EMBODIMENTS

Figure 1:
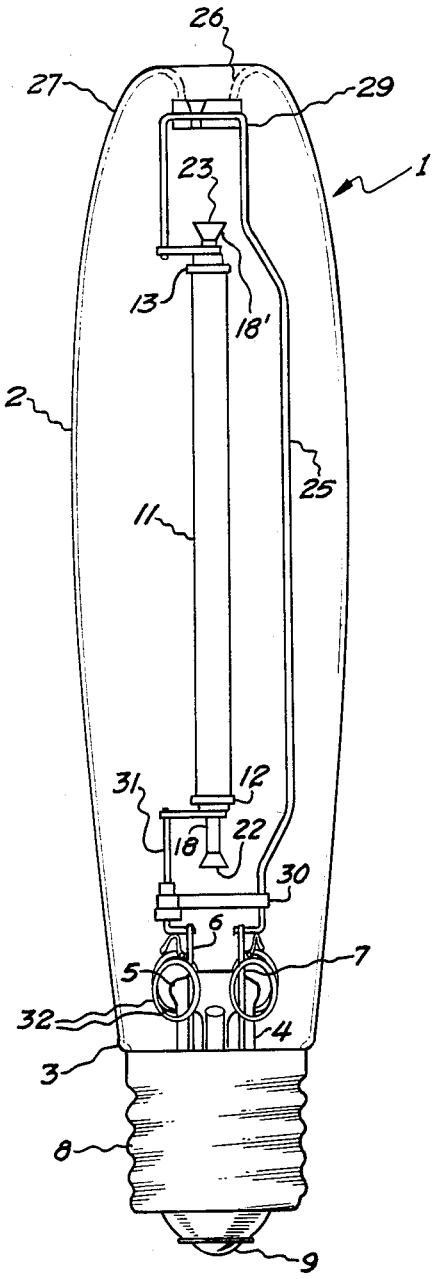
FIG. 1 is a schematic view of a jacketed high pressure sodium vapor lamp embodying the improved emission material of the present invention.

A high intensity sodium vapor discharge lamp in which the invention of the subject application may be embodied, is illustrated at 1 in FIG. 1 and comprises an outer vitreous envelope or jacket 2 of elongated ovoid shape. The neck 3 of the jacket is closed by a reentrance stem 4 having a pressure seal 5 through which extends stiff in-lead wires 6 and 7 which are connected at their outer ends to the threaded shell 8 and center contact 9 of a conventional screw base. The inner envelope or arc tube 11 is made with sintered high density polycrystalline alumina material to provide increased in-line optical transmission. The ends of the tube are closed by thimble-like niobium metal end caps 12 and 13 which have been hermetically sealed to the improved alumina arc tube by means of a glass sealing composition which is shown, although exaggerated in thickness, at 14 in FIG. 2.

Figure 2:
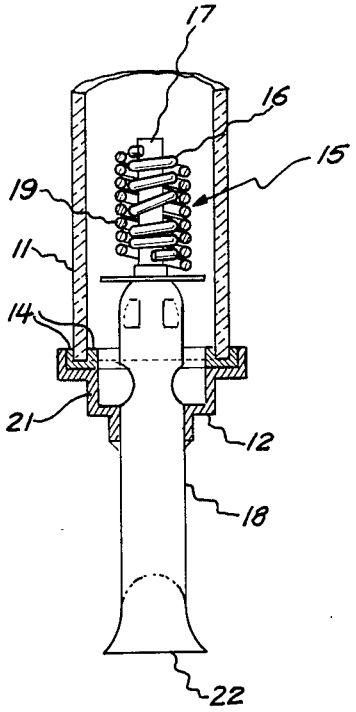
FIG. 2 is a sectional view of an electrode configuration for the lamp depicted in FIG. 1.

Thermionic electrodes 15 are mounted on the ends of the arc tube. As best seen in FIG. 2, the electrode comprises an inner tungsten wire coil 16 which is wound over tungsten shank 17 crimped or welded in the end of a niobium tube 18 which is in turn welded to the end cap 12. The central turns of the inner coil 16 are spread apart and the outer tungsten wire coil 19 is screwed over the inner coil.

Heretofore a suitable electron emissive mix, such as that described in U.S. Pat. No. 3,708,710, has been applied to the electrode coils by painting or alternatively by dipping the coils in the emissive mix suspension. The material is retained primarily in the interstices between the turns of outer and inner coil and of inner coil and shank.

The present invention provides an improved composition for use in connection with the emitter function of high pressure sodium vapor lamps.

Continuing now with the description of a typical high pressure sodium vapor lamp, a lower tube 18 is pierced through at 21 and is used as an exhaust tube during manufacture of said lamp. After the gas filling sodium mercury amalgam has been introduced into the arc tube, exhaust tube 18 is hermetically pinched off by a cold weld indicated at 22 and serves thereafter as a reservoir for condensed sodium mercury amalgam. Upper tube 18 has no opening in the arc tube and is used to contain a small amount of yttrium metal (not shown) which serves as a getter. Yttrium is able to serve as an oxygen getter because it is contained in a niobium metal vessel and the niobium is permeable to oxygen at the temperatures at which the lamp operates. The end of the tube is closed by a pinch 23 which forms a hermetic seal. The illustrated lamp is limited to a base-down operation wherein the longer exhaust tube 18, which must be the coolest portion of the arc tube for the amalgam to condense therein, is located lowermost.

The arc tube is supported within the outer envelope by means of a mount comprising a single rod 25 which extends the length of the envelope from in-lead 7 at the stem end to a dimple 26 at the dome end to which it is anchored by a resilient clamp 27. End cap 13 of the improved arc tube is connected to the frame by band 29 while end cap 12 is connected to in-lead 6 through band 30 and support rod 31.

The inter-envelope space is desirably evacuated in order to conserve heat. The evacuation is done prior to sealing off the outer jacket. A getter, suitable bariumaluminum alloy powder pressed into channeled rings 32 is flashed after sealing in order to insure a high vacuum. A method of manufacturing this type lamp construction is further disclosed in U.S. Pat. No. 3,708,710, which is also incorporated by reference and hence need not be repeated in connection with the present invention.

Figure 3:
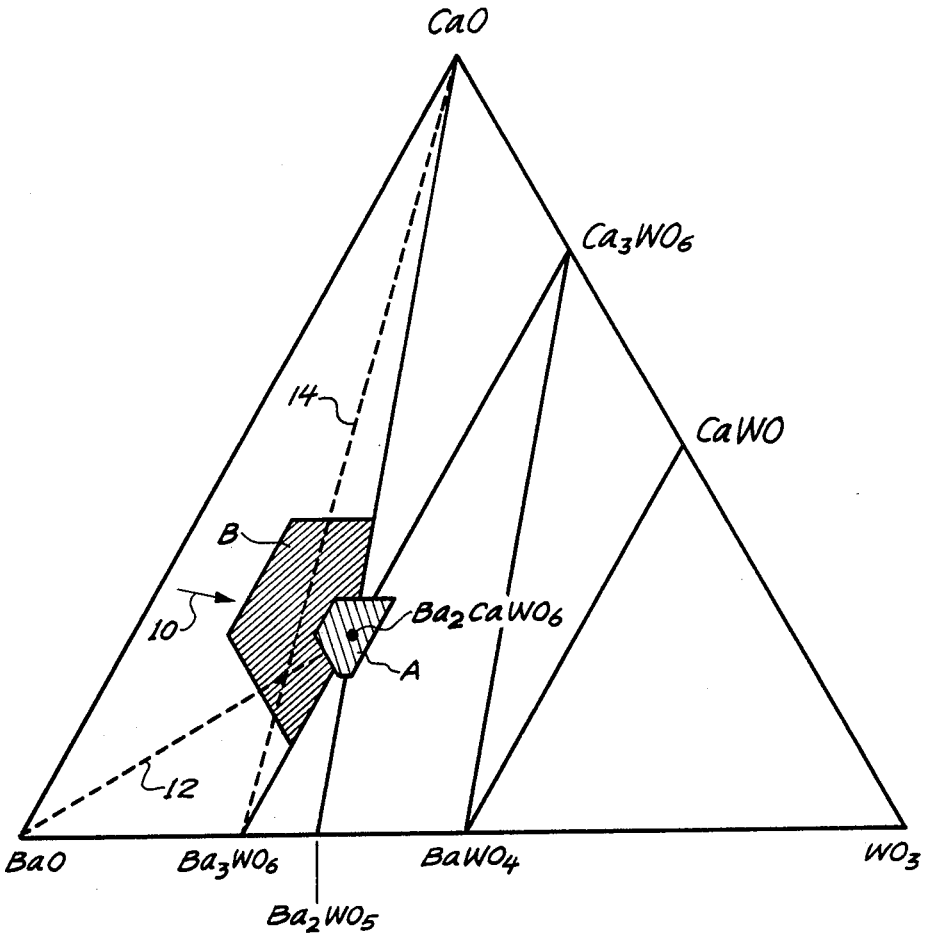
FIG. 3 is a triaxial graph of a ternary composition suitable for use in connection with the present invention.

The U.S. Pat. No. 3,708,710 teaches the combination of a high pressure, HPS, sodium vapor lamp in which an electron emission material is incorporated. The composition of the material corresponds to a portion of the area designated A on the accompanying triaxial plot included in the drawings as FIG. 3.

In the U.S. Pat. No. 3,708,710, it is pointed out that the electrodes of the lamp are required to provide copious electron emission and to be resistant to vaporization and ion bombardment, but that these properties do not in general go together.

The object of that patent was to provide a cathode with electron emissive material which is a good emitter and at the same time more resistant to vaporization and ion bombardment when used in a deluxe high pressure sodium vapor lamp (DHPS) than materials available heretofore. In this the patentees succeeded.

They did so by the discovery that "dibarium calcium tungstate, $Ba_2CaWO_6$, is a better electron-emitting material for use in high intensity discharge lamps and particularly high pressure sodium vapor lamps than any material up to now", see column 1, line 56.

The dibarium calcium tungstate employed in the U.S. Pat. No. 3,708,710 patent is single phase and is prepared by a variety of well-known techniques as is pointed out in the patent. One technique involves ball milling of the starting constituents, namely $BaCO_3$, $CaCO_3$ and $WO_{2.97}$ and then firing in the air at 1700° C. for four hours and then cooling to room temperature. X-ray powder diffraction showed the reaction to the $Ba_2CaWO_6$ to be complete and that only the compound $Ba_2CaWO_6$ to be observed.

Formation of the same composition in situ in the lamp is also disclosed.

The U.S. Pat. No. 3,708,710 also discloses that "the $Ba_2CaWO_6$ phase is that desired but emission material which consists of a $Ba_2CaWO_6$ solid solution phase or a solid solution phase together with small amounts of binary phases are also satisfactory", see column 3, line 15.

It is also pointed out in the U.S. Pat. No. 3,708,710 that compositions having a mole fraction of CaO greater than 0.30 are not desirable due to insufficient electron emission; that compositions richer in BaO than claimed have an evaporation rate many times higher than $Ba_2CaWO_6$; and that any initial advantage of these BaO containing compositions containing a high percent of BaO, due to higher electron emission, is rapidly dissipated. It is rapidly dissipated because of the higher evaporation rate of a physical mixture having constituents outside the range of solid solubility.

What was not recognized at the time of the invention of the U.S. Pat. No. 3,708,710, and what has not been evidently recognized to this date, is that an oxide emission mix can cause sodium loss by chemical reactions involving chemically bound oxygen being released from the emission mix. One such reaction involving tungsten oxide, tungsten metal and gaseous oxygen is as follows:

$$\underline{WO_3(s)} = W(s) + 3O(g) \quad (1)$$

Here, the underline indicates that $WO_3$ is not present as a single oxide but exists at less than unit chemical activity in combination with other oxides. If tungsten metal is not present, the tungsten chemical activity can also be below unity.

By activity of an element or a compound is meant the chemical activity of the element or compound in its indicated chemical environment. As is well known the chemical activity of an element such as tungsten ($a_W$) in an environment containing $WO_3$ at a given temperature is stated by the following expression:

$$a_W = p_W / p_W$$

where $P_w$ = the partial pressure of tungsten in the stated environment, and $p_W$ = the partial pressure of tungsten in an environment containing pure solid tungsten.

The oxygen byproduct from reaction (1) in turn reacts with sodium vapor. The oxygen gas and sodium vapor also react with $Al_2O_3$ from arc tube 11 or with the seal glass of tube 11 to tie up sodium as sodium $\beta$-alumina or sodium aluminate by one or both of the following reactions:

$$2Na(g) + O(g) + 11Al_2O_3 = Na_2O\ 11Al_2O_3(s) \quad (2)$$

$$2Na(g) + O(g) + Al_2O_3(s) = 2NaAlO_2(s) \quad (3)$$

The oxygen also forms sodium tungstate with the mix.

Two approaches for reducing the oxygen are discussed in the applications cross referenced above.

From reaction (1), $P_O \alpha (a_w)^{-033}$. Therefore, another possible approach is to have a maximum activity of tungsten, W, equal to unity throughout the emission mix. Causing an increase in the tungsten activity to unity can be accomplished by adding tungsten metal powder to the emission material.

According to the present invention sodium loss is reduced by limiting the oxygen pressure within the arc tube 11. I accomplish this by adding a small quantity of tungsten powder to the emission mix. This is preferably done to the extent of a maximum of 30 percent by weight. The percent added depends on the particle size of the oxides of the mix as well as that of the added metal powders.

The electrodes used in the HPS and DHPS lamps may also be made of molybdenum. The addition of tungsten metal powder to an emission mix deposited on a molybdenum electrode can also be benefited by the incorporation of powdered tungsten metal into the emission mix.

As little as one percent powdered metal may be added if all powder constituents are of very fine particle size. The highest percentage of metal powder is employed when the oxide powder has finer particle size and the metal powder has larger particle size. The controlling relationships are the surface area to volume ratios of the oxides and the similar surface area to volume ratio of the metal powders.

From reaction (1), based on known thermodynamic principles, the oxygen pressure is lowest if the chemical activity of tungsten is the maximum possible (equal to unity) and that of $WO_3$ is the minimum possible. In accordance with this invention the purpose of adding tungsten powder to the mix is to provide a unit activity of tungsten throughout the emission mix.

The addition of tungsten powder to other emission mixes is also deemed to be beneficial.

The invention is applicable to other emission materials. For some such materials $MoO_3$ or $Y_2O_3$ may be employed in a mix, in place of the mix of $WO_3$, containing other oxides such as BaO, CaO, and SrO. In such cases, pursuant to the present invention, finely divided molybdenum metal or yttrium metal is included in the emission mix containing the respective oxide.

The emission materials proposed in this invention can be made by a variety of techniques well known in the chemical or ceramic art. The oxide mixtures can first be made by any of the techniques suggested in the U.S. Pat. No. 3,708,710, such as a ball milling and firing technique discussed above. To this mixture, a suitable amount of finely divided metal powder of the desired composition can be blended. This would reduce the partial pressure of oxygen in emission mix, which in turn would reduce the sodium loss. The reduction in sodium loss extends the useful life of the HPS and/or DHPS lamps.

When the electrode of a lamp or a lamp component of this invention is made of tungsten, the chemical activity of tungsten in the emission mix particles in contact with the electrode is unity. The addition of tungsten powder to the mix ensures a unit chemical activity of the tungsten throughout the emission mix.

When powdered tungsten metal is absent from the emission mix, the oxides present including the tungsten oxide or barium oxide or calcium oxide can release oxygen by the reaction such as (1) referenced above or by other reactions. The presence of the tungsten powder in the emission mix forestalls the production of oxygen by any of the oxides present in the emission mix.

What is claimed and sought to be protected by Letters Patent of the United States is as follows:

1. As an emission mix for a sodium vapor lamp the composition corresponding to points within the shaped areas A and B of the triaxial plot of FIG. 3 multiphase compositions derived from CaO, BaO and $WO_3$, said mix having a quantity of finely divided tungsten metal dispersed therein.

2. The emission mix of claim 1 in which the points are within shaped area A.

3. A thermionic electrode comprising a wire of a refractory metal selected from the group consisting of molybdenum and tungsten having deposited thereon an emission mix composition corresponding to points within the shaped areas A and B of the triaxial plot of FIG. 3 of compositions of CaO, BaO and $WO_3$, said mix having a quantity of finely divided tungsten metal dispersed therein.

4. The electrode of claim 3 in which the points are within shaped area A.

5. A high intensity electric discharge lamp comprising a light-transmissin envelope having electrodes sealed into its ends and containing an ionizable medium for carrying the discharge, said electrodes consisting of a refractory metal support structure and an electron emissive component applied thereto consisting of a composition corresponding to points within the shaped areas A and B of the triaxial plot of FIG. 3 of multiphase compositions derived from CaO, BaO and $WO_3$, said mix having a quantity of finely divided tungsten metal dispersed therein.

6. A high intensity electric discharge lamp comprising a light-transmissive envelope having electrodes sealed into its ends and containing a ionizable medium for carrying the discharge, said electrodes consisting of a refractory metal support structure and an electron emissive compound applied thereto consisting of a composition corresponding to points within the shaped area A of the triaxial plot of FIG. 3 of multiphase compositions derived from CaO, BaO and $WO_3$, said mix having a quantity of finely divided tungsten metal dispersed therein.

7. In an emission mix for a sodium vapor lamp at lease one oxide of a metal selected from the group consisting of tungsten, molybdenum and yttrium in an emissive oxide mix, said mix containing the same finely divided metal therein.

8. A method of extending the life of a HPS and/or DHPS lamp which comprises, providing a refractory metal electrode within said lamp, applying an emission mix to said electrode to improve emission from the surface thereof, admixing finely divided tungsten metal with said emission mix to increase the chemical activity of said emission mix.

* * * * *